US006789920B2

(12) United States Patent
Liou

(10) Patent No.: US 6,789,920 B2
(45) Date of Patent: Sep. 14, 2004

(54) STICK TYPE OF CHRISTMAS ORNAMENTAL LIGHT DEVICE

(76) Inventor: Ching-Chong Liou, P.O. Box 96-405, Taipei 106 (TW)

( * ) Notice: Subject to any disclaimer, the term of this patent is extended or adjusted under 35 U.S.C. 154(b) by 26 days.

(21) Appl. No.: 10/232,535

(22) Filed: Sep. 3, 2002

(65) Prior Publication Data

US 2004/0042220 A1 Mar. 4, 2004

(51) Int. Cl.[7] ..... F21V 21/00

(52) U.S. Cl. ..... 362/219; 362/249; 362/806; 362/808; 362/252

(58) Field of Search ..... 362/219, 249, 362/252, 806, 808, 391, 235, 431; 52/653.2; 248/158, 159, 149, 156, 161, 157, 125.8, 530; 403/378

(56) References Cited

U.S. PATENT DOCUMENTS 4,803,606 A * 2/1989 Roter ..... 362/250
5,057,981 A * 10/1991 Bowen et al. ..... 362/119
6,398,387 B1 * 6/2002 Wienhold ..... 362/231
D464,159 S * 10/2002 Peloquin ..... D26/67
6,588,723 B1 * 7/2003 Moran, III ..... 248/530
6,612,533 B2 * 9/2003 Biles et al. ..... 248/354.1

* cited by examiner

*Primary Examiner*—Thomas M. Sember
(74) *Attorney, Agent, or Firm*—Troxell Law Office PLLC

(57) ABSTRACT

A stick type of Christmas ornamental light device, which comprises a round pipe is bent into a stick-shaped casing to be connected with a straight second casing having a smaller diameter; the cylindrical holes of the two casings are loaded with a lamp string; the plugs and sockets of the lamp string are left outside the casings; one end of one casing is mounted with a fastening sleeve, of which the center is furnished with a cylindrical hole for receiving a peg so as to facilitate the stick type of the ornamental casing to plant in the ground; then, both sides of a road can be ornamented with the device.

8 Claims, 8 Drawing Sheets

STICK TYPE OF CHRISTMAS ORNAMENTAL LIGHT DEVICE

BACKGROUND OF THE INVENTION

1. Field of the Invention

This invention relates to a Christmas light device, and particularly to a stick type of Christmas light device, which can be planted in the ground as an ornament.

2. Description of the Prior Art

In the conventional Christmas lamp string, the lamp string usually comprises two or more than two wires twisted together mounted with a plurality of sockets connected in series; however, the sockets of such lamp string are not fastened in place properly, the sockets are subject to swinging or being as pendants.

In the conventional lamp string for season festival ornaments, the frame of the lamp string is usually made of metal; then, a lamp string with twisted wires is mounted on the frame; generally, the lamp string is not fastened to the frame properly; consequently, the lamp string is subject to separating from the frame. Some parts of the lamp string may be fastened in place with wire or the like, but the sockets and power-supply wires are still under a swinging and pendent condition.

In some Christmas lamp strings, the sockets are facing in one direction without pending swinging by means of a hook furnished on one side of every socket to hook up the power-supply wires.

In a conventional Christmas lamp string, the lamp string is mounted in an ornamental casing, in which a socket-fastening channel is furnished so as to have every socket fixed at a given position. After the ornamental casing and the lamp string are assembled together, the bulb in every socket will be lit up to wink so as to provide an ornamental function.

In a conventional Christmas lamp string device, a soft hose-pipe is loaded with a plurality of Christmas lamp strings; generally, several power-supply wires are pulled out and connected in series to form into several lamp strings; the sockets of the lamp strings are arranged in a given sequence; then, the power-supply wires and the sockets thereon are pulled into the soft hose-pipe, which can be mounted in a straight or ring-shaped condition, and fastened in place with a cord.

SUMMARY OF THE INVENTION

The prime object of the present invention is to provide a stick type of Christmas ornamental light device, in which a round pipe is bent into a stick-shaped casing to be connected with a straight second casing having a smaller diameter; the cylindrical holes of the two casings are loaded with a lamp string; the plugs and sockets of the lamp string are left outside the casings; one end of one casing is mounted with a fastening sleeve, of which the center is furnished with a cylindrical hole for receiving a peg so as to facilitate the stick type of the ornamental casing to plant in the ground; then, both sides of a road can be ornamented with the device.

A further object of the present invention is to provide a stick type of Christmas ornamental light device, in which the bent stick type of casing can be plugged with a straight casing having a smaller diameter; the cylindrical holes of the two casings are loaded with a lamp string, of which the power-supply wires have a length slightly longer than that of the two casings upon being extended fully; the two casings can be retracted together to facilitate packing.

A still further object of the present invention is to provide a stick type of Christmas ornamental light device, in which the tail end of the bent casing is mounted with an end plug, which is furnished with a ring to be connected with a hook assembly on the front end of a lamp string so as to prevent the lamp string from sliding away upon the two casings being pulled and extended to a normal length.

Another object of the present invention is to provide a stick type of Christmas ornamental light device, in which the two casings can be connected each other by plugging; after the two casings are pulled in extended position, the ends of two casings are furnished with two round holes which can be coincided each other for receiving a pin so as to have the two casing fixed at a given length without moving, i.e., to form into stick type of ornament.

Still another object of the present invention is to provide a stick type of Christmas ornamental light device, in which the lower end of the straight casing is mounted with a fastening sleeve to be connected with the casing through a flexible hook; the inside of the fastening sleeve is furnished with two symmetrical wire channels for receiving and laying power-supply wires respectively; the cylindrical hole in the center thereof is used for mounting the peg so as to facilitate the stick type of ornamental casing to plant in the ground.

DETAILED DESCRIPTION OF THE PREFERRED EMBODIMENT

Figure 1:
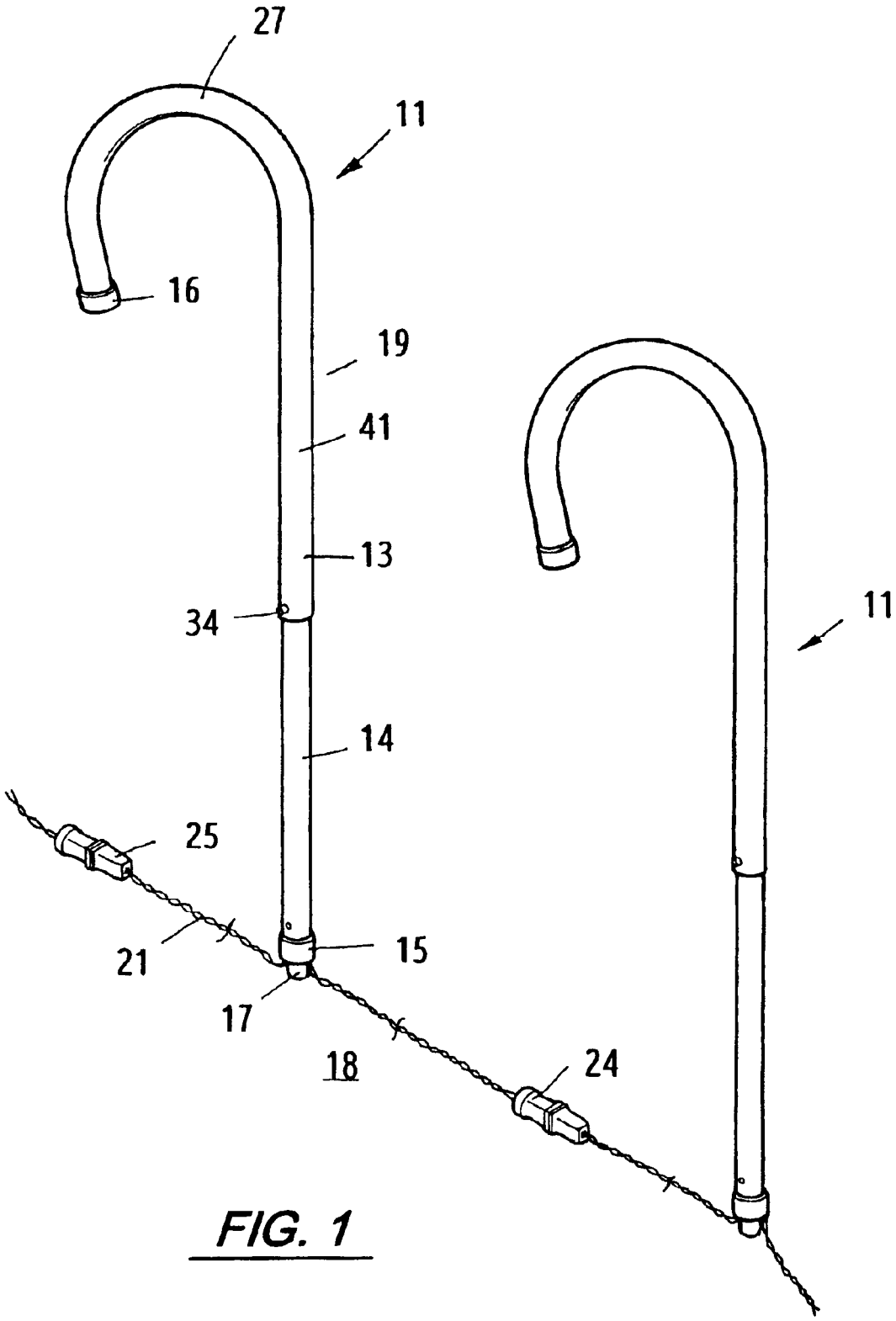
FIG. 1 is a perspective view of the present invention, showing the stick type of Christmas ornamental lights planted in the ground.
Figure 2:
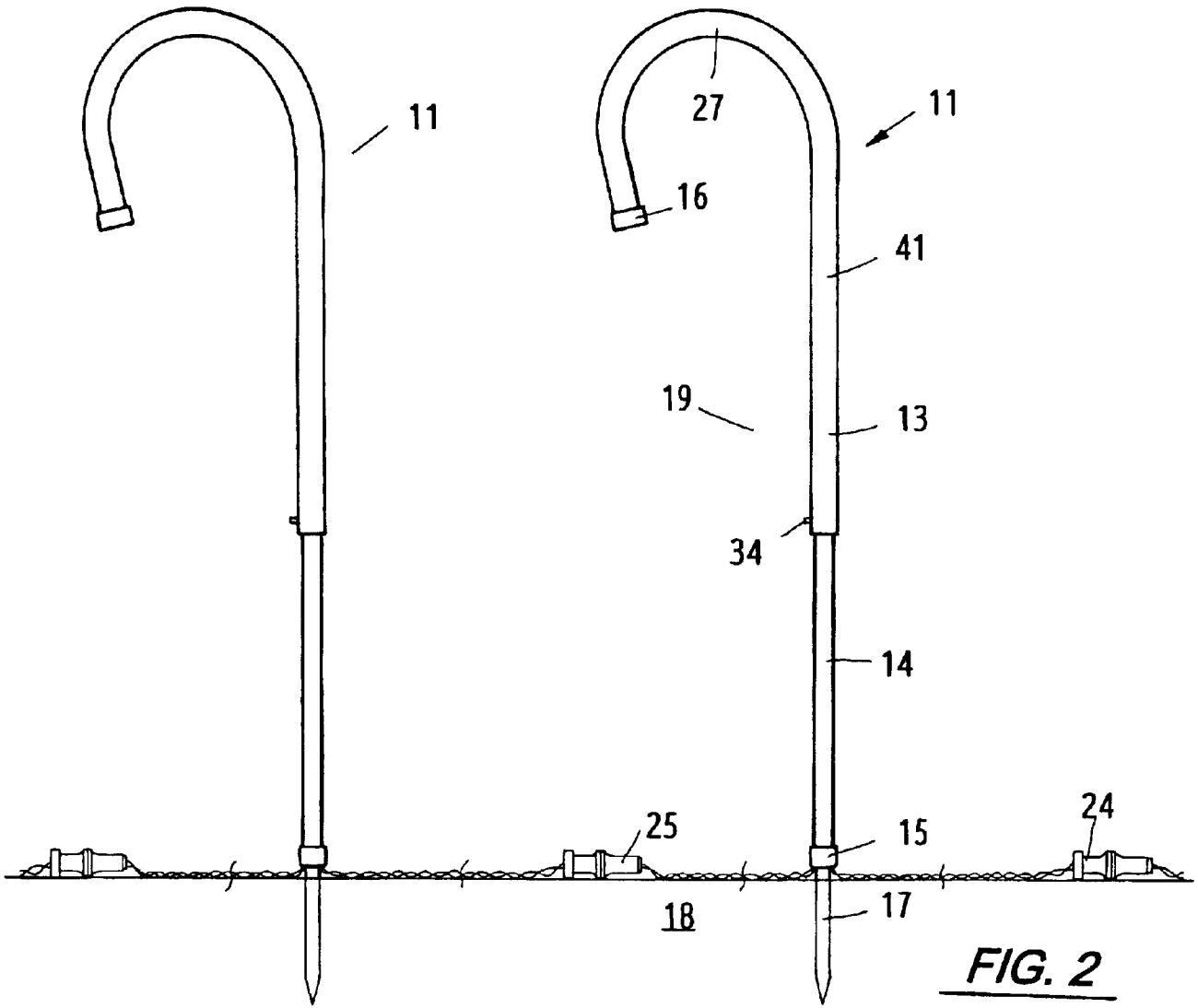
FIG. 2 is a sectional view of the present invention.
Figure 3:
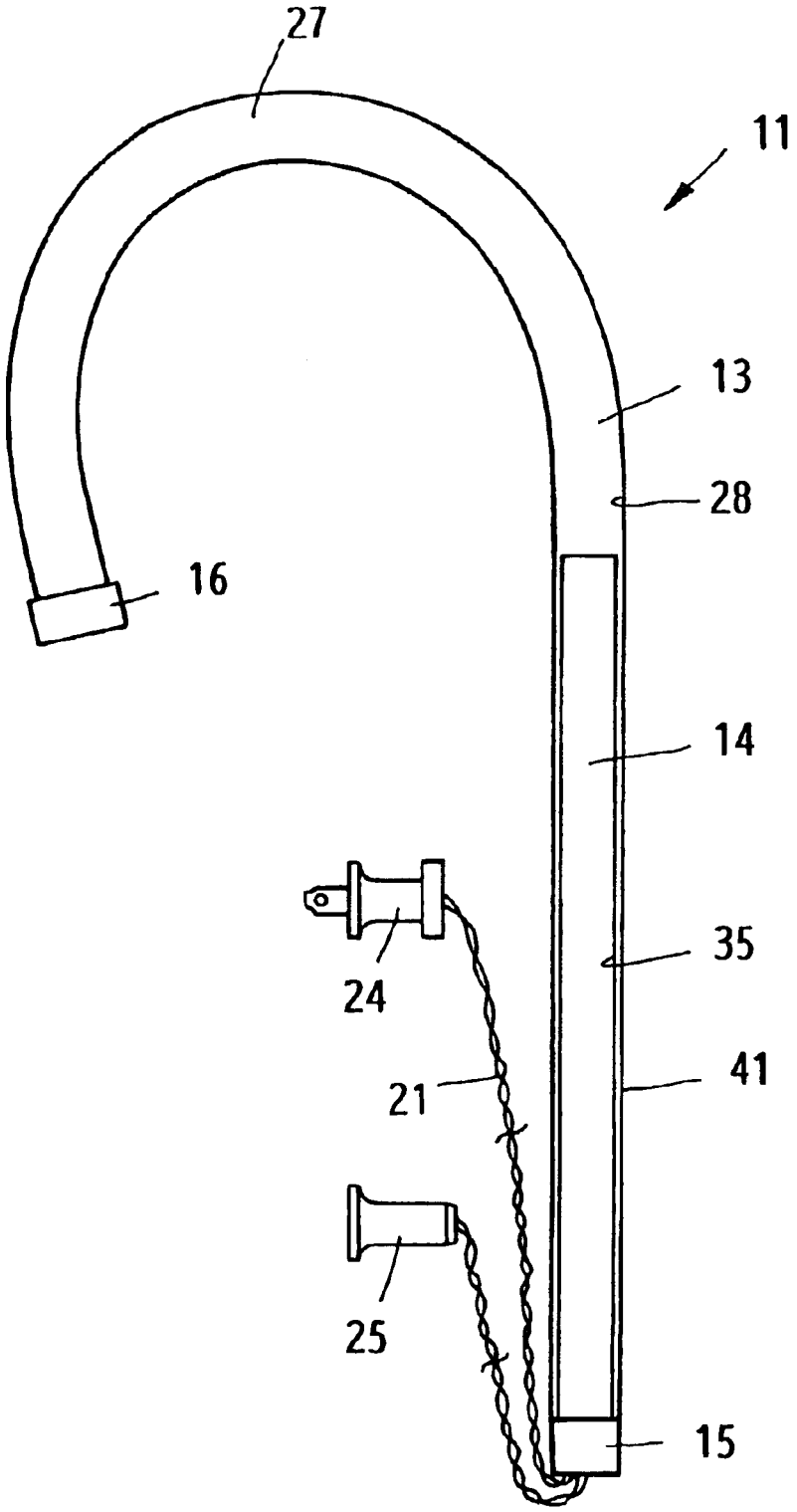
FIG. 3 is a plan view of the present invention, showing the Christmas ornamental lights retracted in short condition.
Figure 4:
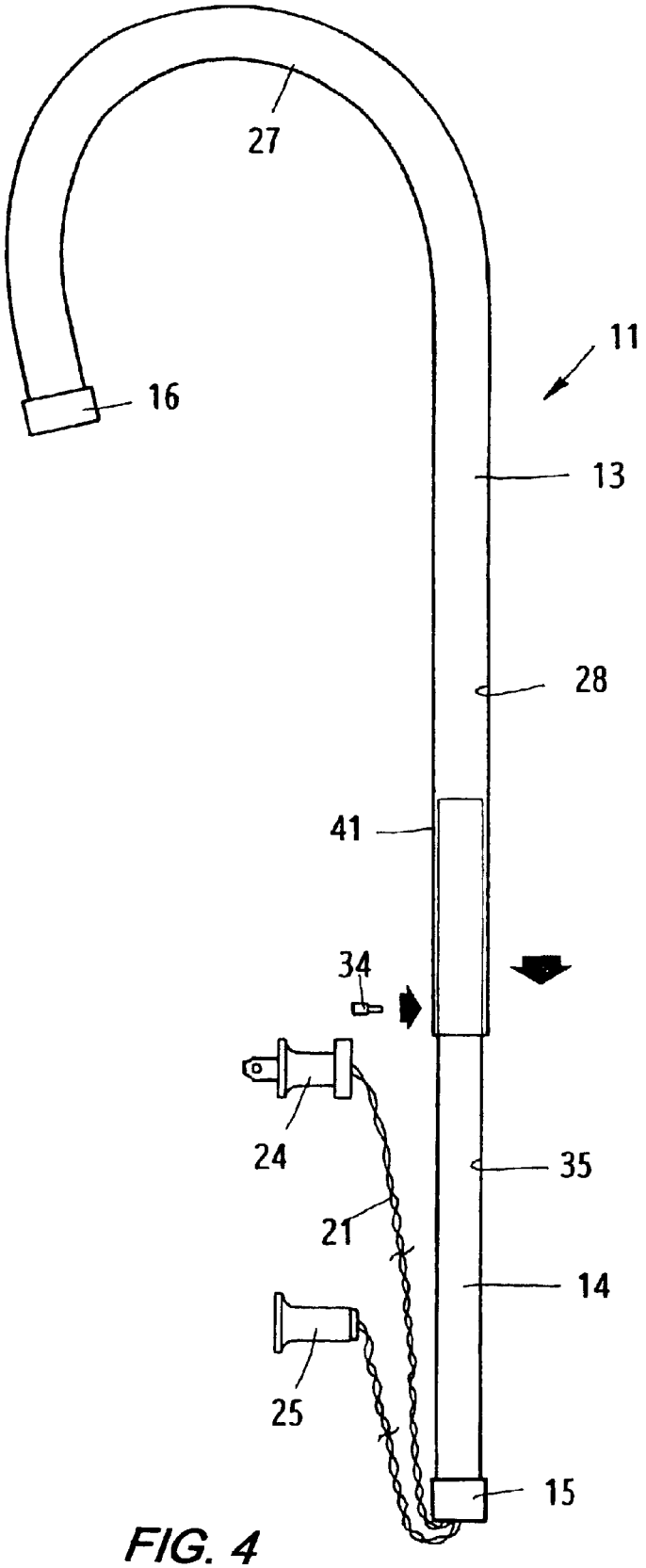
FIG. 4 is a plan view of the present invention, showing the Christmas ornamental lights extended in normal length.

This invention relates to a stick type of Christmas ornamental light device; as shown in FIGS. 1 to 4, the ornamental casing 19 of the Christmas lights 11 is bent into stick type; the inside for the ornamental casing 19 is mounted with a lamp string 12. The ornamental casing 19 includes two casings 13 and 14, which can be retracted into a shorter body so as to facilitate packing and storage. In use, the two casings 13 and 14 are pulled and extended into a normal length; there are two opposite round holes furnished between the two casings 13 and 14 for receiving a pin 34 so as to have the two casings 13 and 14 assembled together. The lower end of the second casing 14 is mounted with a fastening sleeve 15 so as to facilitate the power-supply wires 21 to pull out; the center of the fastened sleeve 15 is mounted with a peg 17, which enables the ornamental casing 19 to plant on the ground surface 18. Two ornamental casings 19 can be connected in series with wires, a plug 24 and a socket 25; then, a plurality of the stick type of ornamental casings can be planted in the ground along two sides of a road as an ornament.

The ornamental casing 19 includes two casings 13 and 14; the first casing 13 includes a bent pipe 27 and a straight pipe 41; the length of the straight pipe 41 is designed to fit in with that of a pipe mounted in the cylindrical hole 28; when the two casings 13 and 14 are pulled to an extended condition, a suitable height of the ornamental casing 19 will have. After the two casings 13 and 14 are retracted together, the second casing 14 will be pushed into the cylindrical hole 28 in the straight pipe 41 so as to facilitate the Christmas lights 11 to be stored in place.

Figure 5:
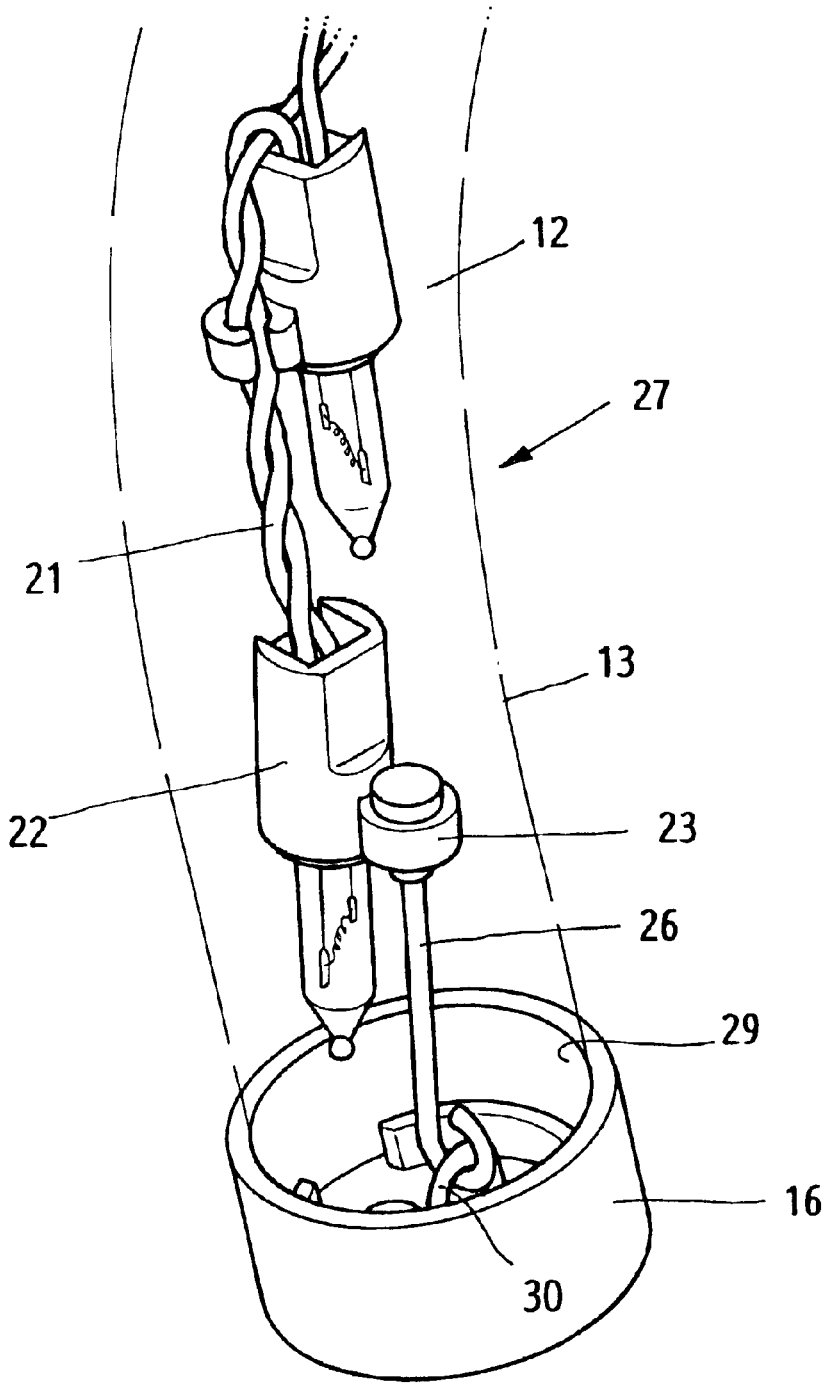
FIG. 5 is a fragmental perspective view of the present invention, showing the end structure of the bent portion thereof.
Figure 6:
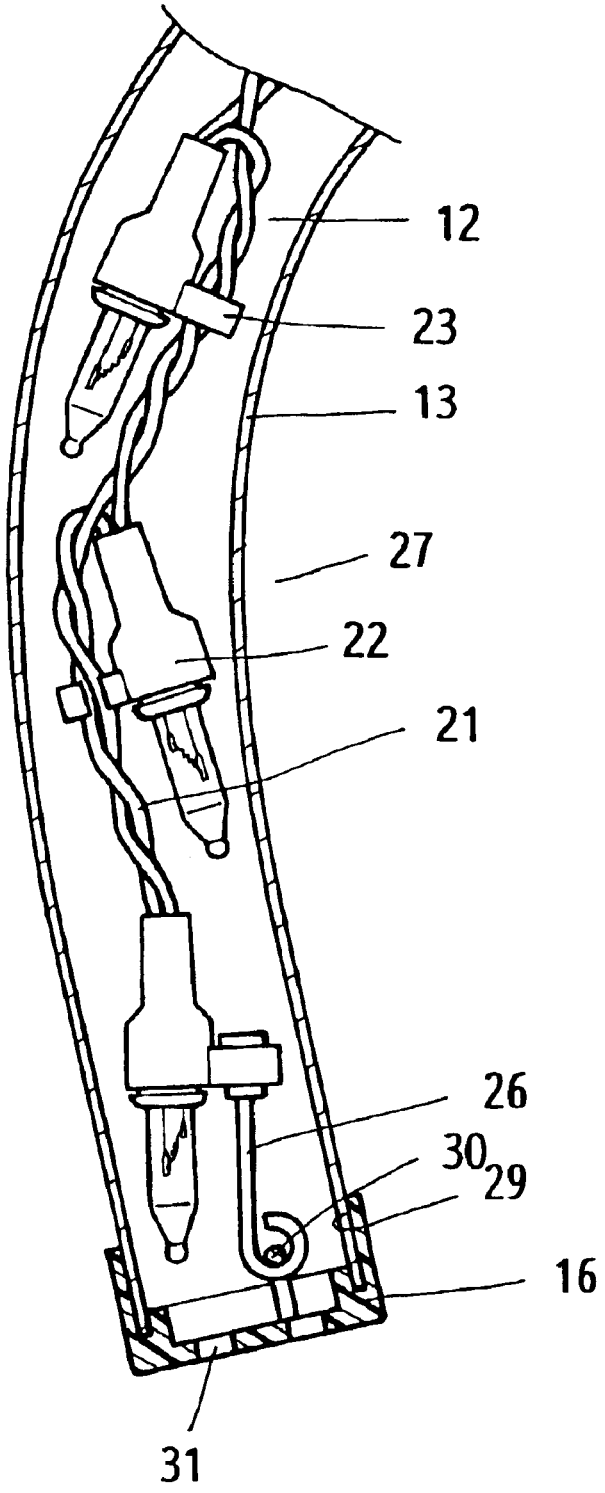
FIG. 6 is a fragmental perspective view of the present invention, showing the end structure of the bent portion thereof.
Figure 7:
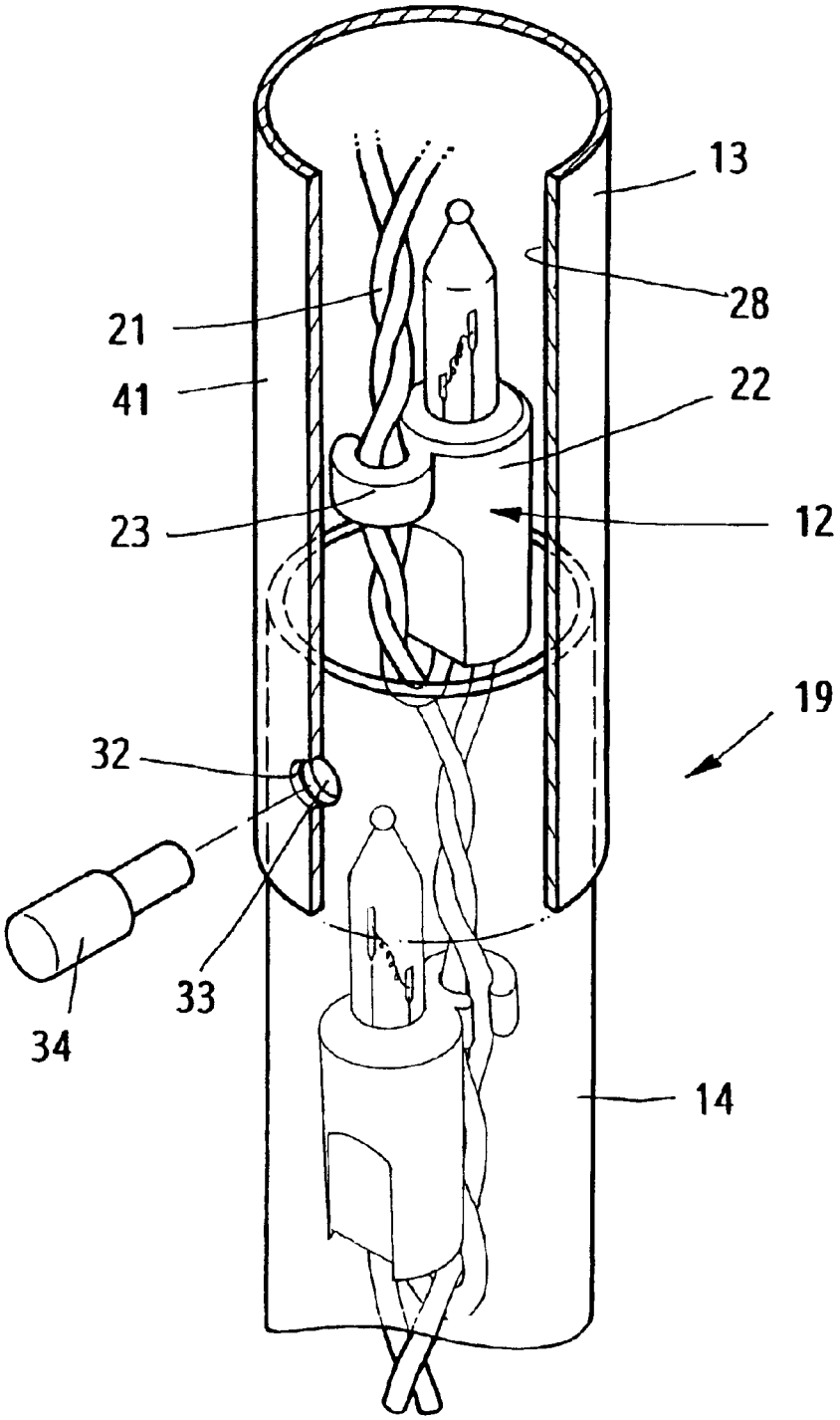
FIG. 7 is a fragmental perspective view of the present invention, showing the assembled structure of the two casings.
Figure 8:
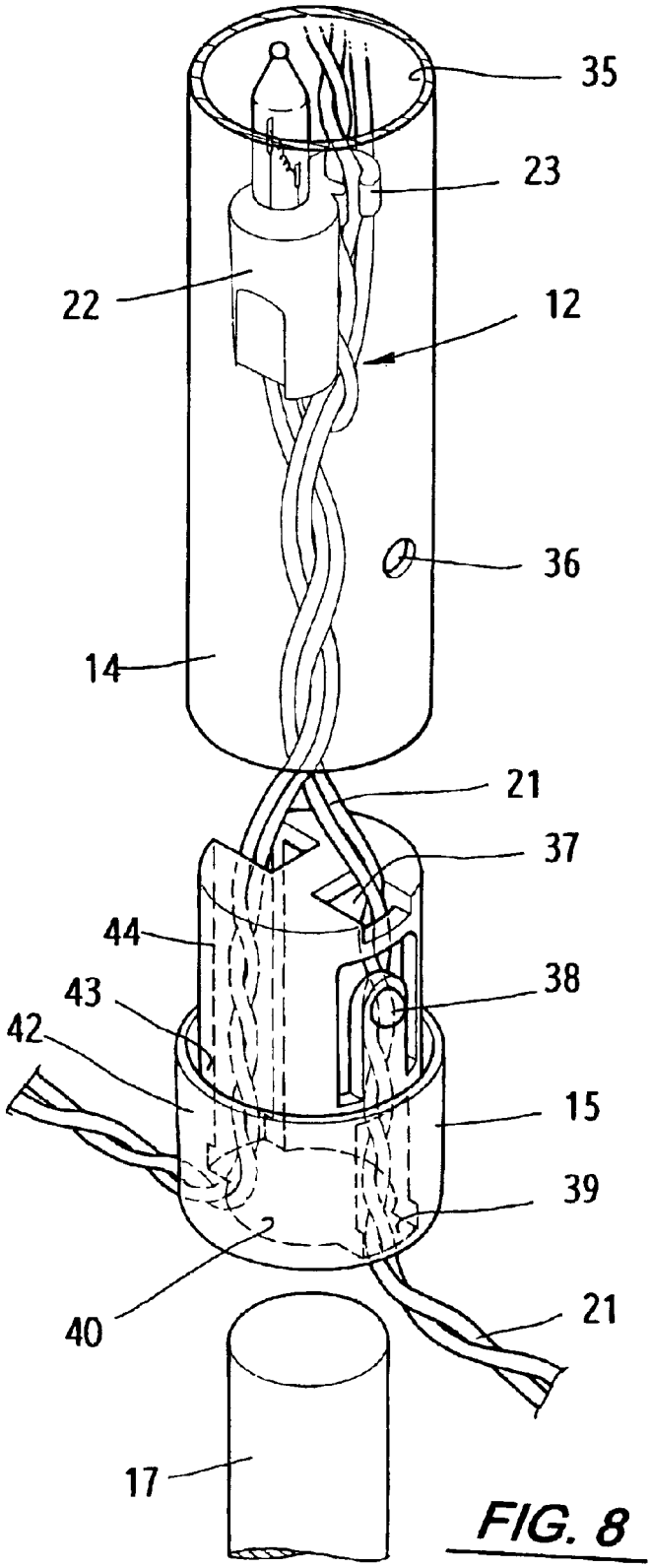
FIG. 8 is a fragmental perspective view of the present invention, showing the structure between the fastening sleeve and the casing thereof.

As shown in FIGS. 1 to 8, the inside of the casings 13 and 14 of the ornamental casing 19 is mounted with a lamp string 12, of which one side of each socket 22 is furnished with a hook 23 so as to facilitate the socket 22 to be hooked on the power-supply wires 21, and to have the sockets 22 faced in one direction in order to have the lamp string 12 mounted in the cylindrical holes 28 and 35 of the two casings 13 and 14 easily. The tail end of the bent pipe 27 of the first casing 13 mounted with an end plug 16, of which the surface has a vent 31, and the inside of end plug is furnished with a ring 30 to be hooked up with a hook assembly 26, which is attached a hook 23 at one side of a socket 22 on the tail end of the lamp string 12; by means of the hook assembly 26, the lamp string 12 can be fastened in place without moving.

The cylindrical hole 28 of the straight pipe 41 in the first casing 13 is used for receiving the second casing 14 having a smaller diameter. The outer surface of the second casing 14 is in close contact with the cylindrical hole 28 of the first casing 13. One side of end of the straight pipe 41 has a through round hole 32; one side of the end of the casing 14 mounted in the cylindrical hole 28 of the casing 13 is also furnished with a through round hole 33; after the two casings 13 and 14 are pulled to extend to a given length, the two round holes 32 and 33 can be set in a coincident position for receiving a pin 34 so as to limit the two casing 13 and 14 to move, i.e., the two casings 13 and 14 wound not separate or retract from each other.

One end of the second casing 14 in the cylindrical hole 28 is mounted with a fastening sleeve 15, in which a cylinder body 44 is furnished; the cylinder body 44 is plugged into a cylindrical hole 35 of the second casing 14; one side of the cylinder body 44 is furnished with a flexible hook 38; the fastening sleeve 15 can engage with the round hole 36 of the second casing 14 by means of the flexible hook 38 so as to prevent the fastening sleeve 15 and the second casing 14 from separating.

The fastening sleeve 15 is plugged into the cylindrical hole 35 of the second casing 14 by means of the cylinder body 44; one end of the second casing 14 is plugged into the round hole 43 of the fastening sleeve 15; one end of the second casing 14 is covered with the outer ring 42 of the fastening sleeve 15; the diameter of the outer ring 42 of the fastening sleeve 15 is about equal to the outer diameter of the first casing 13. When the two casings 13 and 14 are put in storage condition, the outer ring 42 of the fastening sleeve 15 and the end of the casing 13 should be set on a same level.

The center of the cylinder body 44 of the fastening sleeve 15 is furnished with a cylindrical hole 40, of which both sides are furnished with two symmetrical wire channels 39 respectively; two symmetrical wire-separation holes 37 are furnished on both sides of the cylinder body 44 respectively; the two wire-separation holes 37 used for receiving two power-supply wires 21 respectively, and then the two wires are pulled out of the two symmetrical wire channels 39 respectively. One side of the cylinder body 44 is furnished with a flexible hook 38 to be fastened together with a through round hole 36 furnished on one side of the second casing 14 upon the second casing 14 and the fastening sleeve 15 being assembled together so as to prevent the fastening sleeve 15 and the second casing 14 from separation.

The cylindrical hole 40 in the fastening sleeve 15 is used for mounting the peg 17; before the peg 17 is mounted in place, the two power-supply wires 21 of the lamp string 12 must be pulled out of the wire channels 39 respectively so as to facilitate the peg 17 to fit on.

To assemble the Christmas lights 11, the two casings 13 and 14 have to be connected and retracted to the shortest length; a wire is pulled into the cylindrical hole of the first casing 13, and then is connected with the hook assembly 26 of the first socket 22 of the lamp string 12; then, at least a given number of sockets 22 and the power-supply wires 21 of the lamp string 12 must be pulled into the cylindrical holes of the two casings 13 and 14. Two power-supply wires 21, which are not connected with the socket 22, are put into the wire-separation hole 37 of the fastening sleeve 15, and they are connected with the sockets 22 of the lamp string 12; such wires are then pulled to the first socket 22 out of the first casing 13; the hook assembly 26 and the ring 30 of the end plug 16 are hooked up; the end plug 16 is mounted on the end of the second casing 14; then, the second casing 14 in the cylindrical hole 28 of the first casing 13 is pulled out so as to connect with the fastening sleeve 15. After the second casing 14 is pulled out, the sockets 22 and the power-supply wires 21, which are not put in, should be pulled into the cylindrical hole, After the second casing 14 and the fastening sleeve 15 are assembled together, all the sockets 22 of the lamp string 12 will be put into the cylindrical holes 28 and 35 of the two casings 13 and 14. When the two casings 13 and 14 are retracted, the sockets 22 of a lamp string 12 will be pushed closer one another so as to facilitate the ornamental casing 19 to store up. In real use, the two casings 13 and 14 must be pulled to a given length, and fastened in place by plugging a pin 34 into the two coincident round holes 32 and 33; a peg 17 is plugged into the cylindrical hole 40 of the fastening sleeve 15 on one end that the power-supply wires 21 are pulled out. After the peg 17 is driven into the ground, two adjacent lamp strings 12 can be connected together with a plug 24 and a socket 25; then, the entire lamp strings can be connected one another as an ornament.

According to the aforesaid description of the embodiment of the present invention, the features and structure of the present invention have been disclosed completely; it is apparent that the present invention has provided obvious improvement, which is never anticipated and achieved by any person in the field; therefore, the structure thereof is deemed unique.

What is claimed is:

1. A stick type of Christmas ornamental light device which has an ornamental casing mounted with a lamp string herein, and two power-supply wires pulled out of lower end thereof, and said ornamental casing comprising:

a first casing, of which one end formed into a bent pipe, and one end of said bent pipe mounted with an end plug, while other end thereof being a straight pipe with a cylindrical hole for receiving a round pipe having a smaller diameter;

a second casing, a round pipe, of which one end mounted into a cylindrical hole of said first casing, while other end thereof mounted with a fastening sleeve;

a pin to be plugged into two coincident round holes of said two casings upon being pulled at a given length;

a fastening sleeve mounted on one end of said second casing, and center thereof having a cylindrical hole for receiving a peg, wherein said fastening sleeve has a cylinder body to plug into a cylindrical hole of said second casing, of which one end plugged into a round hole of said fastening sleeve; outer end of said second casing covered with an outer ring.

2. A stick type of Christmas ornamental light device which has an ornamental casing mounted with a lamp string herein, and two power-supply wires pulled out of lower end thereof, and said ornamental casing comprising:

a first casing, of which one end formed into a bent pipe, and one end of said bent pipe, mounted with an end plug, while other end thereof being a straight pipe with a cylindrical hole for receiving a round pipe having a smaller diameter;

a second casing, a round pipe, of which one end mounted into a cylindrical hole of said first casing, while other end thereof mounted with a fastening sleeve;

a pin to be plugged into two coincident round holes of said two casings upon being pulled at a given length;

a fastening sleeve mounted on one end of said second casing, and center thereof having a cylindrical hole for receiving a peg, wherein one side of said cylinder body of said fastening sleeve has a flexible hook; one end of said second casing furnished with a round hole; said flexible hook to be connected with said second casing.

3. A stick type of Christmas ornamental light device having an ornamental casing with a lamp string mounted therein and two power-supply wires extending from a lower end thereof, the ornamental casing comprising:

a) a first casing having:
- i) a bent pipe;
- ii) a straight pipe connected to the bent pipe and having a first hole through a periphery thereof;
- iii) a first cylindrical hole extending through the bent pipe and the straight pipe;
- iv) a first end adjacent to the bent pipe; and
- v) a second end adjacent to the straight pipe;

b) an end plug connected to the first end of the first casing;

c) a second casing slidably inserted into the first cylindrical hole of the straight pipe and having:
- i) a first end located within the first casing;
- ii) a second end;
- iii) a second hole through a periphery thereof; and
- iv) a second cylindrical hole extending through the second casing, the second casing being moveable between a stored position and an extended position;

d) a locking device positioning the first and second casings in the extended position, wherein the second casing extends out of the first casing a predetermined distance;

e) a fastening sleeve connected to the second end of the second casing and having a second cylindrical hole; and f) a peg inserted into the second cylindrical hole of the fastening sleeve.

4. The ornamental casing according to claim 3, wherein the locking device is a pin, the first hole of the first casing and the second hole of the second casing are aligned, the pin is removably inserted through the first and second holes.

5. The ornamental casing according to claim 3, wherein the straight pipe of the first casing is longer than the second casing.

6. The ornamental casing according to claim 3, wherein the fastening sleeve includes a cylinder body, an outer ring, and a round hole, the round hole is located between the cylinder body and the outer ring, the cylinder body inserted into the second cylindrical hole at the second end of the second casing, the outer ring is located on an outer periphery of the second casing.

7. The ornamental casing according to claim 3, wherein the fastening sleeve has a flexible hook, the second casing has a third hole in an outer periphery thereof the flexible hook selectively engaging the third hole of the second casing.

8. The ornamental casing according to claim 3, further comprising a hook assembly connecting one end of the lamp string to the end plug.

* * * * *